US007336042B2

(12) United States Patent
Toriumi et al.

(10) Patent No.: US 7,336,042 B2
(45) Date of Patent: Feb. 26, 2008

(54) DISPLAY APPARATUS EMPLOYING A FIELD EMISSION DEVICE AND BRIGHTNESS CONTROL DEVICE AND METHOD THEREFOR

(75) Inventors: Masaki Toriumi, Chiba (JP); Mitsuru Tanaka, Chiba (JP); Yuji Obara, Chiba (JP); Kenichi Furumata, Chiba (JP)

(73) Assignee: Futaba Corporation, Chiba (JP)

( * ) Notice: Subject to any disclaimer, the term of this patent is extended or adjusted under 35 U.S.C. 154(b) by 15 days.

(21) Appl. No.: 11/487,395

(22) Filed: Jul. 17, 2006

(65) Prior Publication Data

US 2007/0013318 A1 Jan. 18, 2007

(30) Foreign Application Priority Data

Jul. 15, 2005 (JP) ..... 2005-206827

(51) Int. Cl.
*H05B 37/02* (2006.01)

(52) U.S. Cl. ..... 315/308; 315/309; 315/169.3; 345/211

(58) Field of Classification Search .. 315/169.1–169.3, 315/307, 308, 309; 313/501–503; 345/76, 345/77, 204, 211–214
See application file for complete search history.

(56) References Cited

U.S. PATENT DOCUMENTS 5,656,892 A 8/1997 Zimlich et al. ..... 315/169.3
5,939,833 A 8/1999 Song et al. ..... 315/169.3
6,326,938 B1 * 12/2001 Ishida et al. ..... 345/63
6,888,519 B2 * 5/2005 Yamano et al. ..... 345/75.2
7,098,875 B2 * 8/2006 Onozawa et al. ..... 345/60
2005/0104837 A1 * 5/2005 Baik et al. ..... 345/99

FOREIGN PATENT DOCUMENTS

JP 2001-324955 11/2001

OTHER PUBLICATIONS

Field Emission Display (FED) and Digital Micromirror Device (DMD), SHARP (see http://sharp-world.com/sc/library/lcd_e/s2_6_3e.htm) no date available.

* cited by examiner

*Primary Examiner*—Douglas W. Owens
*Assistant Examiner*—Jimmy Vu
(74) *Attorney, Agent, or Firm*—Bacon & Thomas, PLLC

(57) ABSTRACT

A display apparatus includes a field emission device including a first electrode serving as a display plate on which phosphor material is coated, and a second and a third electrode for emitting electrons to be ejected onto the first electrode, wherein the phosphor material emits light when the electrons are ejected thereonto; a voltage application unit for applying driving voltages to the second and the third electrode to control an emitted amount of the electrons in accordance with display data and allow a specific part of the phosphor material to emit light; and a brightness control unit for controlling an emission brightness of the phosphor material. The brightness control unit includes a first electrode current detection unit, a display data amount estimation unit, a comparing unit, a preset value generation unit, an average turn-on rate detection unit, an average turn-on rate analysis unit, and a selection unit.

9 Claims, 9 Drawing Sheets

DISPLAY APPARATUS EMPLOYING A FIELD EMISSION DEVICE AND BRIGHTNESS CONTROL DEVICE AND METHOD THEREFOR

FIELD OF THE INVENTION

The present invention relates to a display apparatus employing a field emission device and a brightness control device of the field emission device and a brightness control method therefor.

BACKGROUND OF THE INVENTION

Recently, display apparatuses using a field emission device (hereinafter, abbreviated as "FED") have become promising candidates expected to be widely employed in household and industrial applications. FIG. 8 shows a cross sectional view depicting an exemplary Spindt type field emission unit 100 used as an electron emission source in a conventional FED, wherein the entire structure of the FED is not shown. The field emission unit 100 includes cathode electrodes 102 and gate electrodes 106 as essential electrodes. The cathode electrodes 102 and the gate electrodes 106 are formed by being deposited on a dielectric cathode substrate 101.

The cathode electrodes 101 made of a conductive material and cathode electrode wirings 103 are formed on and in contact with an upper surface of the cathode substrate 101. Further, a resistor layer 104 is formed on the cathode electrodes 102 and the cathode electrode wirings 103, and an insulating layer 105 is formed on and in contact with an upper surface of the resistor layer 104. Furthermore, the gate electrodes 106 made of a conductive material are formed on and in contact with an upper surface of the insulating layer 105. Above the cathode electrodes 102 are formed openings 107 in the insulting layer 105 and the gate electrodes 106, and emitters 108 of a trigonal pyramid shape are formed in the openings 107 to be in electrical contact with the resistor layer 104.

The cathode electrodes 102 are arranged in parallel in Y-direction (i.e., a direction toward a backside from a front side of the sheet of FIG. 8), and the gate electrodes 106 are arranged in parallel in X-direction (i.e., a direction from left to right in FIG. 8). Further, each of the cathode electrodes 102 is orthogonal to each of the gate electrodes 106, thereby forming a matrix.

An anode substrate (not shown) is installed to face an upper surface of the cathode substrate 101 at a specific distance on which the gate electrodes 106 are formed. Further, the anode substrate facing the field emission unit 100 includes an anode electrode (not shown) on which phosphor material is coated, and the anode electrode serves as a display plate. Further, the cathode substrate 101 and the anode electrode form a closed space, whose inside is maintained at a vacuum level.

Hereinafter, an exemplary operation of a FED having such configuration will be described. First, an electric potential that is positive with respect to the cathode electrodes 102 is applied to the anode electrode. Then, display data are assigned to a driver unit 112 (shown in FIG. 9) having first drivers respectively connected to the cathode electrodes. Meanwhile, an electric potential for making the emitters 108 emit electrons is applied to one of the gate electrodes 106 by using second drivers respectively connected to the gate electrodes 106 (not shown), and an electric potential is applied to the remaining gate electrodes 106 to prevent the emitters 108 thereof from emitting electrons.

Thus, electrons are emitted from gate emitters, i.e., a part of the emitters 108 installed in the openings 107 of the gate electrode 106 to which the electric potential for making the emitters 108 thereof emit electrons is applied, so that the electrons are ejected onto the anode electrode at positions corresponding to the respective gate emitters. Thus, the phosphor material in an area corresponding to the ejected positions emits light whose brightness depends on the display data, so that a single line display is performed in X-direction, i.e., in a direction in which the gate electrodes 106 are extended. In this manner, the gate electrodes 106 are scanned, i.e., sequentially selected one by one as a selected gate electrode to which a selection potential, i.e., an electric potential for making the emitters 108 thereof emit electrons, is applied and, at the same time, the display data corresponding to the scanned positions are assigned to the respective cathode electrodes 102, so that an image is displayed on an entire surface of the FED.

In such FED, the anode current is varied significantly depending on a change in the temperature thereof, thereby causing a change in the emission brightness.

FIG. 9 depicts a display apparatus capable of preventing an anode current from changing depending on a temperature change in a FED (see Japanese Patent Laid-open Application No. 2001-324955). With reference thereto, this display apparatus will be described in the following.

The display apparatus shown in FIG. 9 includes a FED 110; an anode current detector unit 111 for detecting an average current, i.e., an average value of an anode current flowing through an anode of the FED 110 over a specific period of time; a driver unit 112 for driving cathode electrodes that are functionally equivalent to the cathode electrodes 102 in FIG. 8; a display data output unit 113 for supplying a driving voltage to the driver unit 112 in accordance with display data; a display data amount detector unit 114 for counting an amount of the display data over a specific period of time; a reference voltage output unit 115 for generating and outputting a reference current, i.e., a reference value of the anode current based on the counted amount of the display data; a comparator 117 for comparing the average current with the reference current; a gate voltage control unit 118 for adjusting a voltage applied to gate electrodes that are functionally equivalent to the gate electrodes 106 in FIG. 8 if the average current is not same as the reference current; and a ROM 116 in which a table for generating the reference current is stored. Thus, the emission brightness is stabilized by adjusting the voltage applied to the gate electrodes 106 to control the anode current in response to the display data.

Herein, the anode current detector unit 111, the comparator 117 and the gate voltage control unit 118 form a feedback control system by which an output voltage of the gate voltage control unit 118 is automatically controlled in such a manner that an output voltage of the comparator 117 becomes 0, thereby restraining the temperature dependence of the emission brightness of the FED 110.

Since the above-described display apparatus stabilizes the emission brightness by using the feedback control system, the effect of such factors as a temperature change can be suppressed, so that its temperature characteristic is improved remarkably if the anode current is relatively large and the emission brightness of the FED 110 is relatively high.

However, if the emission brightness of the FED 110 is low, the detected current is very small, and therefore it becomes difficult to control the brightness. To be more specific, a signal to noise ratio (SNR) of the anode current to be compared by the comparator 117 is reduced, and a blind zone of the anode current range which has been introduced to stabilize the feedback control system becomes too wide to be neglected in comparison with the anode current, thereby making it difficult to detect the anode current accurately.

Further, if the above-described method of controlling the brightness by using the feed-back is employed by a display apparatus when the emission brightness is as low as described above, the stabilization of the emission brightness may be even interfered in some cases.

SUMMARY OF THE INVENTION

It is, therefore, an object of the present invention to provide a display apparatus employing a field emission device, and brightness control device and method therefor capable of stabilizing a brightness regardless of a temperature change or the like, even when the brightness of the FED is low.

In accordance with the present invention, there is provided a display apparatus including: a field emission device including a first electrode serving as a display plate on which phosphor material is coated, and a second and a third electrode for emitting electrons to be ejected onto the first electrode, wherein the phosphor material emits light when the electrons are ejected thereonto; a voltage application unit for applying driving voltages to the second and the third electrode to control an emitted amount of the electrons in accordance with display data and allow a specific part of the phosphor material to emit light; and a brightness control unit for controlling an emission brightness of the phosphor material, wherein the brightness control unit includes: a first electrode current detection unit for detecting a signal corresponding to a current flowing through the first electrode over a specific period of time; a display data amount estimation unit for detecting a signal corresponding to the display data inputted to the second electrode over the specific period of time; a comparing unit for generating an error signal representing a difference between the signal corresponding to the current flowing through the first electrode and the signal corresponding to the display data; a preset value generation unit for generating a preset value; an average turn-on rate detection unit for calculating an average turn-on rate indicating a degree to which the phosphor material emits light over the specific period of time; an average turn-on rate analysis unit for finding whether the average turn-on rate is greater than, equal to or smaller than a threshold value; and a selection unit for making the third electrode driven by a feedback control system in accordance with the error signal if the average turn-on rate is found to be greater than or equal to the preset value, and by the preset value if the average turn-on rate is found to be smaller than the preset value.

As described above, the display apparatus in accordance with the present invention stabilizes an emission brightness by a brightness control device. Each element of the brightness control device operates as follows to achieve the object of the invention. A first electrode current detection unit detects a signal corresponding to a current flowing through the first electrode over a specific period of time. A display data amount estimation unit detects a signal corresponding to the display data inputted to the second electrode over the specific period of time. A comparing unit generates an error signal representing a difference between the signal corresponding to the current flowing through the first electrode and the signal corresponding to the display data. A preset value generation unit generates a preset value. An average turn-on rate detection unit calculates an average turn-on rate indicating a degree to which the phosphor material emits light over the specific period of time. An average turn-on rate analysis unit finds whether the average turn-on rate is greater than, equal to or smaller than a threshold value. A selection unit makes the third electrode driven by a feedback control system in accordance with the error signal if the average turn-on rate is found to be greater than or equal to the preset value, and by the preset value if the average turn-on rate is found to be smaller than the preset value.

In accordance with the present invention, there is provided a brightness control device for controlling an emission brightness of a field emission device including a first electrode serving as a display plate on which phosphor material is coated, and a second and a third electrode for emitting electrons to be ejected onto the first electrode, the phosphor material emitting light when the electrons are ejected thereonto, the brightness control device including: a first electrode current detection unit for detecting a signal corresponding to a current flowing through the first electrode over a specific period of time; a display data amount estimation unit for detecting a signal corresponding to the display data inputted to the second electrode over the specific period of time; a comparing unit for generating an error signal representing a difference between the signal corresponding to the current flowing through the first electrode and the signal corresponding to the display data; a preset value generation unit for generating a preset value; an average turn-on rate detection unit for calculating an average turn-on rate indicating a degree to which the phosphor material emits light over the specific period of time; an average turn-on rate analysis unit for finding whether the average turn-on rate is greater than, equal to or smaller than a threshold value; and a selection unit for making the third electrode driven by a feedback control system in accordance with the error signal if the average turn-on rate is found to be greater than or equal to the preset value, and by the preset value if the average turn-on rate is found to be smaller than the preset value.

As described above, the brightness control device in accordance with the present invention stabilizes an emission brightness. Each element of the brightness control device operates as follows to achieve the object of the invention. A first electrode current detection unit detects a signal corresponding to a current flowing through the first electrode over a specific period of time. A display data amount estimation unit detects a signal corresponding to the display data inputted to the second electrode over the specific period of time. A comparing unit generates an error signal representing a difference between the signal corresponding to the current flowing through the first electrode and the signal corresponding to the display data. A preset value generation unit generates a preset value. An average turn-on rate detection unit calculates an average turn-on rate indicating a degree to which the phosphor material emits light over the specific period of time. An average turn-on rate analysis unit finds whether the average turn-on rate is greater than, equal to or smaller than a threshold value. A selection unit makes the third electrode driven by a feedback control system in accordance with the error signal if the average turn-on rate is found to be greater than or equal to the preset value, and by the preset value if the average turn-on rate is found to be smaller than the preset value.

In accordance with the present invention, there is provided a brightness control method of controlling an emission brightness of a field emission device including a first electrode serving as a display plate on which phosphor material is coated, and a second and a third electrode for emitting electrons to be ejected onto the first electrode, the phosphor material emitting light when the electrons are ejected thereonto, the brightness control method comprising the steps of: detecting a signal corresponding to a current flowing through the first electrode over a specific period of time; detecting a signal corresponding to the display data inputted to the second electrode over the specific period of time; generating an error signal representing a difference between the signal corresponding to the current flowing through the first electrode and the signal corresponding to the display data; finding whether the average turn-on rate is greater than, equal to or smaller than a threshold value, the average turn-on rate indicating a degree to which the phosphor material emits light over the specific period of time; and making the third electrode driven by a feedback control system in accordance with the error signal if the average turn-on rate is found to be greater than or equal to the preset value, and by the preset value if the average turn-on rate is found to be smaller than the preset value.

As described above, the brightness control method in accordance with the present invention performs the following operations. First, a signal corresponding to a current flowing through the first electrode over a specific period of time is detected. Next, a signal corresponding to the display data inputted to the second electrode over the specific period of time is detected. Next, an error signal representing a difference between the signal corresponding to the current flowing through the first electrode and the signal corresponding to the display data is generated. Thereafter, it is checked whether the average turn-on rate is greater than, equal to or smaller than a threshold value, the average turn-on rate indicating a degree to which the phosphor material emits light over the specific period of time. Finally, the third electrode is made to be driven by a feedback control system in accordance with the error signal if the average turn-on rate is found to be greater than or equal to the preset value, and by the preset value if the average turn-on rate is found to be smaller than the preset value.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENT

Hereinafter, a preferred embodiment of the present invention will be described with reference to FIGS. 1 and 2.

Figure 1:
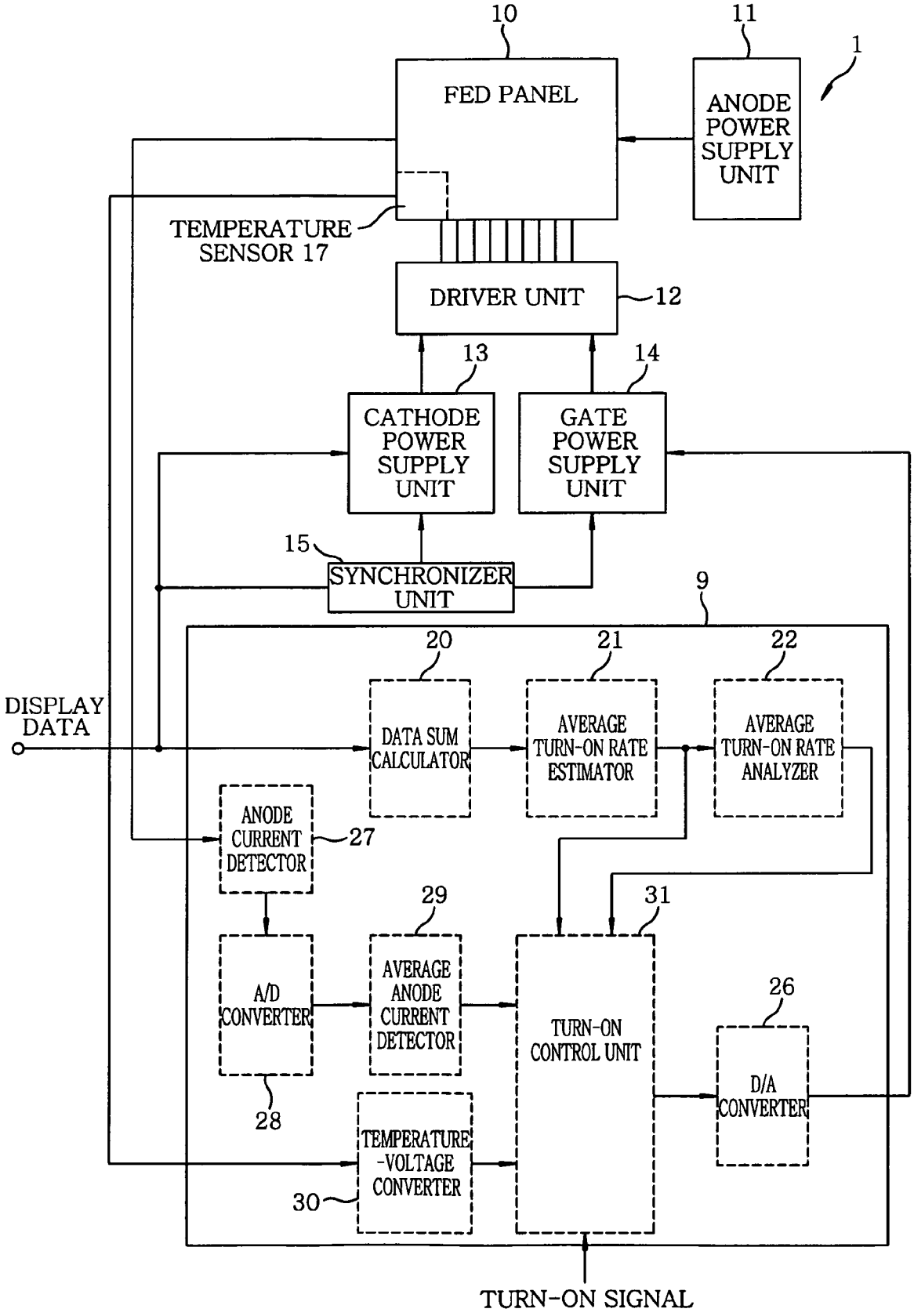
FIG. 1 shows a block diagram of a display apparatus in accordance with the present invention.

FIG. 1 shows a block diagram of a display apparatus 1 employing a FED in accordance with the preferred embodiment of the present invention. In FIG. 1, a brightness control device 9 in a FED panel 10 is depicted especially in detail. The brightness control device 9 functions as an exemplary brightness control unit in accordance with the preferred embodiment of the present invention.

The display apparatus 1 includes the brightness control device 9; the FED panel 10; an anode power supply unit 11; a driver unit 12; a cathode power supply unit 13; a gate power supply unit 14; and a synchronizer unit 15. Hereinafter, each of them will be described in detail.

Figure 8:
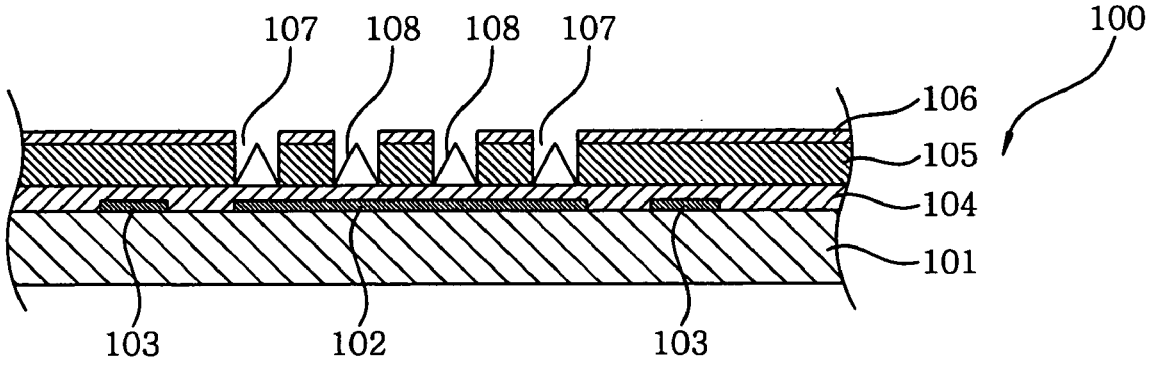
FIG. 8 (PRIOR ART)
FIG. 8 sets forth a cross sectional view depicting an exemplary field emission unit in a conventional FED.
Figure 9:
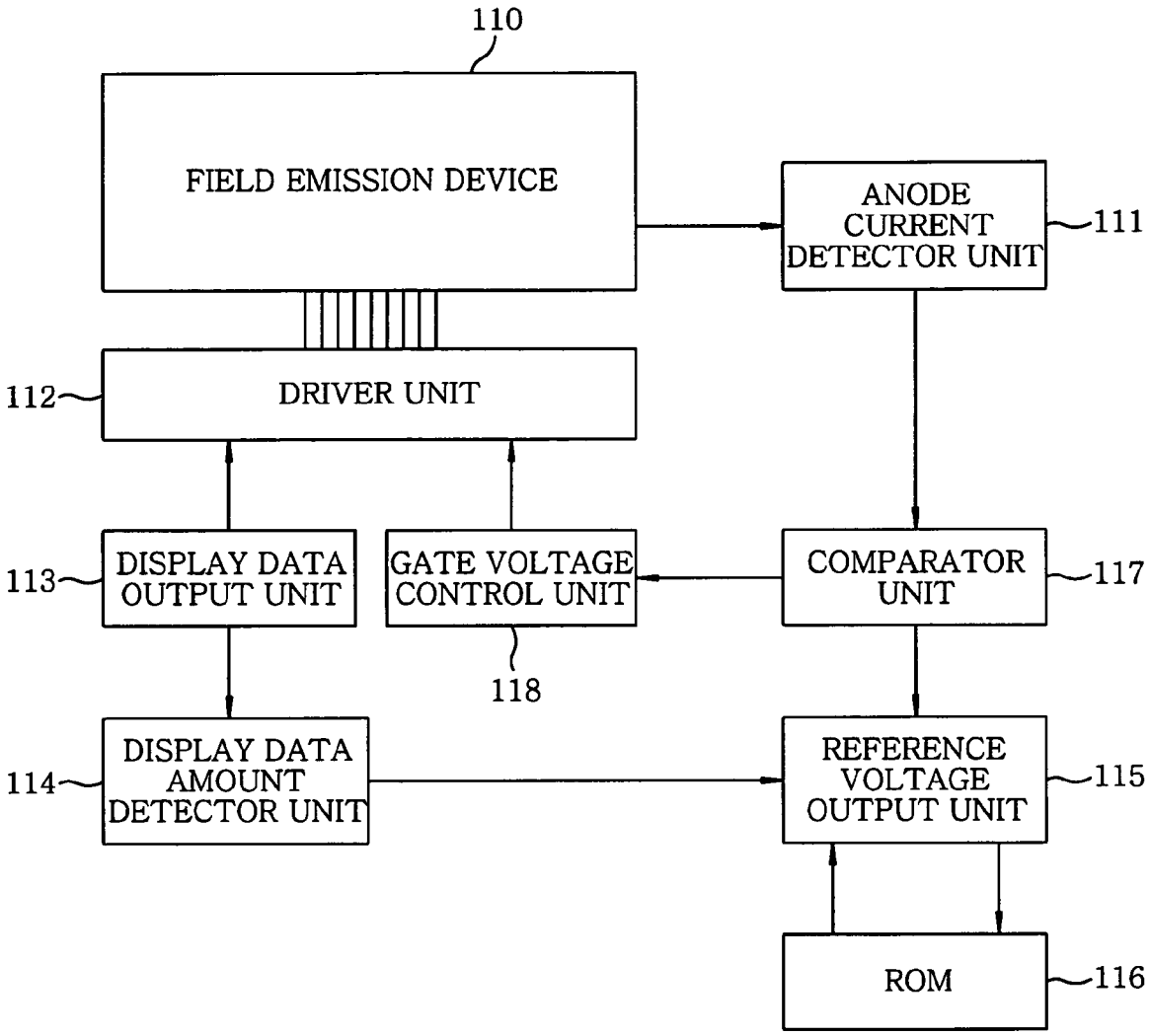
FIG. 9 (PRIOR ART)
FIG. 9 provides a configuration diagram of a display apparatus of a prior art.

The FED panel 10 employs a field emission unit (not shown) functionally equivalent to the Spindt type field emission unit 100 shown in FIG. 8. The FED panel 10 is an exemplary field emission display device, and is configured as a thin type panel. In the FED panel 10, cathode electrodes (not shown) functionally equivalent to those shown in FIG. 8 are arranged side by side in a row (i.e., in Y-direction as described above), and gate electrodes (not shown) functionally equivalent to those shown in FIG. 8 are arranged side by side in a column (i.e., in X-direction as described above). Further, each of the cathode electrodes is orthogonal to each of the gate electrodes, thereby forming a matrix. Furthermore, emitters are arranged on each of the cathode electrodes via a resistor layer as shown in FIG. 8.

Further, the FED panel 10 includes an anode electrode on which phosphor material is coated. Thus, by applying a voltage between the gate electrodes and the emitters, the phosphor material emits light whose brightness varies in accordance with an amount of electrons ejected from the emitters, thereby performing a display on the FED panel 10 as intended. In accordance with the preferred embodiment of the present invention, the anode electrode functions as a first electrode, the cathode electrodes function as second electrodes, and the gate electrodes function as third electrodes.

The anode power supply unit 11 is a power supply unit for applying an electric power to the anode electrode, and a predetermined voltage positive with respect to the cathode electrodes is applied to the anode.

The driver unit 12 supplies electric powers to the cathode electrodes and the gate electrodes. Herein, cathode elements of the driver unit 12 respectively corresponding to the cathode electrodes are configured to drive the respective cathode electrodes by voltages respectively applied thereto in accordance with the voltage supplied by the cathode power supply unit 13. Further, gate elements of the driver unit 12 respectively corresponding to the gate electrodes are configured to drive the respective gate electrodes by voltages respectively applied thereto in accordance with the voltage supplied by the gate power supply unit 14. The driver unit 12 functions as an exemplary voltage application unit in accordance with the preferred embodiment of the present invention.

More specifically, the cathode power supply unit 13 is configured to supply the respective cathode electrodes with voltages via the driver unit 12 in accordance with the respective display data. Further, in case of employing a line sequential driving method, the display data include a plurality of data, wherein the number of the data is such that each of the data matches on a one-to-one basis to a corresponding pixel located on a horizontal scanning line. Herein, each of the pixels is synchronized in a horizontal direction with a corresponding display data by the synchronizer unit 15.

Further, the gate power supply unit 14 is configured to supply the respective gate electrodes with voltages via the driver unit 12. That is, a voltage corresponding to an output of a D/A converter 26 installed in the brightness control device 9 is applied to a selected gate electrode, wherein the gate electrodes are sequentially selected one by one as the selected gate electrode. To the remaining gate electrodes (i.e., non-selected gate electrodes) are applied voltages for preventing emitters of the remaining gate electrodes from emitting electrons. Further, each of the pixels is synchronized in a vertical direction with a corresponding display data by the synchronizer unit 15.

The brightness control device 9 is a main part of the present invention, and performs a digital processing. The brightness control device 9 may be configured by a field programmable logic array (FPGA), a micro processing unit (MPU) or a separate discrete device. However, in the following, the brightness control device 9 will be described in detail for a case where it employs the FPGA.

The brightness control device 9 includes a data sum calculator 20; an average turn-on rate estimator 21; an average turn-on rate analyzer 22; an anode current detector 27; an A/D converter 28; an average anode current detector 29; a temperature-voltage converter 30; a turn-on control unit 31; and a D/A converter 26.

The data sum calculator 20 sums up the display data to obtain a data sum. The addition is performed within a single frame (i.e., data of a single still image displayed in the frame on the FED panel 10). The operation performed by the data sum calculator 20 can be represented by Eq. 1, wherein Sd is the data sum, i.e., a total sum of the display data of a single frame.

$$Sd = \sum_{1}^{M}\sum_{1}^{N} Dh(m, n) \qquad \text{Eq. 1}$$

Herein, M designates the number of pixels in a row in a single frame, and N designates the number of pixels in a column in a single frame, Dh(m,n) designates a value of display data corresponding to a pixel located at an mth row and an nth column, and $$\sum_{1}^{M}\sum_{1}^{N}$$

designates a sum of the display data from Dh(1,1) to Dh(M,N). The data sum calculator 20 is configured by an accumulator for summing accumulated values of the display data for every single frame. As for the timing when the data sum Sd is to be obtained, the data sum calculator 20 may be configured such that the values of the display data are accumulated for every single frame to obtain the data sum Sd at a time when a next frame is started. Alternatively, the data sum calculator 20 may also be configured such that a moving sum of the display data is calculated by adding up the display data in a manner that the number of the display data to be added is equal to that contained in a single frame, thereby obtaining the data sum Sd whenever a new value of the display data is inputted to the data sum calculator 20. In this case, an error signal used in a feedback control system is updated every time when a new value of the display data is inputted to the data sum calculator 20, so that the response characteristic can be enhanced.

The average turn-on rate estimator 21 obtains an average turn-on rate At. The average turn-on rate At is the data sum Sd divided by a maximum data sum Sm, i.e., a data sum of the display data in a single frame in case every value of the display data is equal to W, wherein W is a largest possible value of the display data (i.e., a display data value corresponding to a white level). The average turn-on rate estimator 21 is configured by a divider. In the following, Eq. 2 is an equation for calculating the average turn-on rate At.

$$At = Sd / Sm = \sum_{1}^{M}\sum_{1}^{N} Dh(m, n) / (M \times N \times W) \qquad \text{Eq. 2}$$

If, for example, all the M×N pixels in a single frame have display data value of W (i.e., the frame emits light with a maximum brightness), the average turn-on rate At is equal to 1. Further, if M×N/2 pixels, i.e., half of the pixels in a single frame have display data value of W and the remaining half of the pixels in the frame have display data value of 0, the average turn-on rate At is equal to 0.5. Still further, if all the M×N pixels in a single frame have display data value of W/2, the average turn-on rate At is equal to 0.5. In addition, if the data sum calculator 20 is configured to calculate a moving sum of the display data as described above, the average turn-on rate estimator 21 also obtains a moving sum of Eq. 2 whenever a new value of the display is inputted to the data sum calculator 20 by adding up Dh(m,n)/(M×N×W) iii a manner that the number of terms to be added is equal to that of display data contained in a single frame. Herein, the data sum calculator 20 and the average turn-on rate estimator 21 function as an exemplary display data amount estimation unit and an exemplary average turn-on rate estimation unit in accordance with the preferred embodiment of the present invention, respectively.

The average turn-on rate analyzer 22 determines whether the average turn-on rate At obtained by using Eq. 2 is greater than, equal to or smaller than a specific value (threshold value), and is configured by a magnitude comparator. The threshold value is set to be, for example, 0.3, and a high level signal is outputted from the average turn-on rate analyzer 22 if the average turn-on rate At is greater than or equal to 0.3, whereas a low level signal is outputted from the average turn-on rate analyzer 22 if the average turn-on rate At is smaller than 0.3. Herein, the average turn-on rate analyzer 22 functions as an exemplary average turn-on rate analysis unit.

The anode current detector 27 detects a magnitude of an anode current, i.e., a current flowing in the anode by, for example, allowing the anode current to flow through a resistor (not shown) and then detecting a voltage between both ends of the resistor. The A/D converter 28 converts an analog value of the current detected by the anode current detector 27 into a digital value.

The average anode current detector 29 calculates an accumulated average of digital values outputted from the A/D converter to obtain an average value of the anode current over a time interval corresponding to a single frame. If, for example, a dot sequential method is employed as the driving method, the anode currents of all the pixels in a single frame are added up and then an average thereof is calculated. Further, if a line sequential method is employed as the driving method, the anode currents of all the scanning lines in a single frame are added up and then an average thereof is calculated. Still further, if a field sequential method is employed as the driving method, the anode current corresponding to a single frame is obtained and then an average thereof over the time interval is calculated. Herein, the resistor used for detecting the anode current, the A/D converter 28 and the average anode current detector 29 function as an exemplary first electrode current detection unit.

The temperature-voltage converter 30 converts a temperature into a voltage. The temperature is detected by a temperature sensor 17 installed inside of a cathode electrode substrate in the FED panel 10. Herein, the temperature sensor 17 and the temperature-voltage converter 30 function as an exemplary temperature detection unit. A configuration of the temperature sensor 17 is not limited as long as the temperature sensor 17 detects the temperature in the FED panel 10, and the temperature sensor 17 may be installed in the cathode electrode substrate or in a vicinity of the FED panel.

The turn-on control unit 31 may be configured in various ways. Therefore, in accordance with the preferred embodiment of the present invention, the brightness control device 9 is configured by the FPGA as described above such that various configurations can be implemented by rewriting the FPGA. A first to a third preferred embodiment of the present invention differ from each other only in that the turn-on control units therein are different. Hereinafter, the first to the third preferred embodiment will be described with reference to the drawings. Further, a fourth preferred embodiment and other examples of alternative embodiments will also be described.

Figure 2:
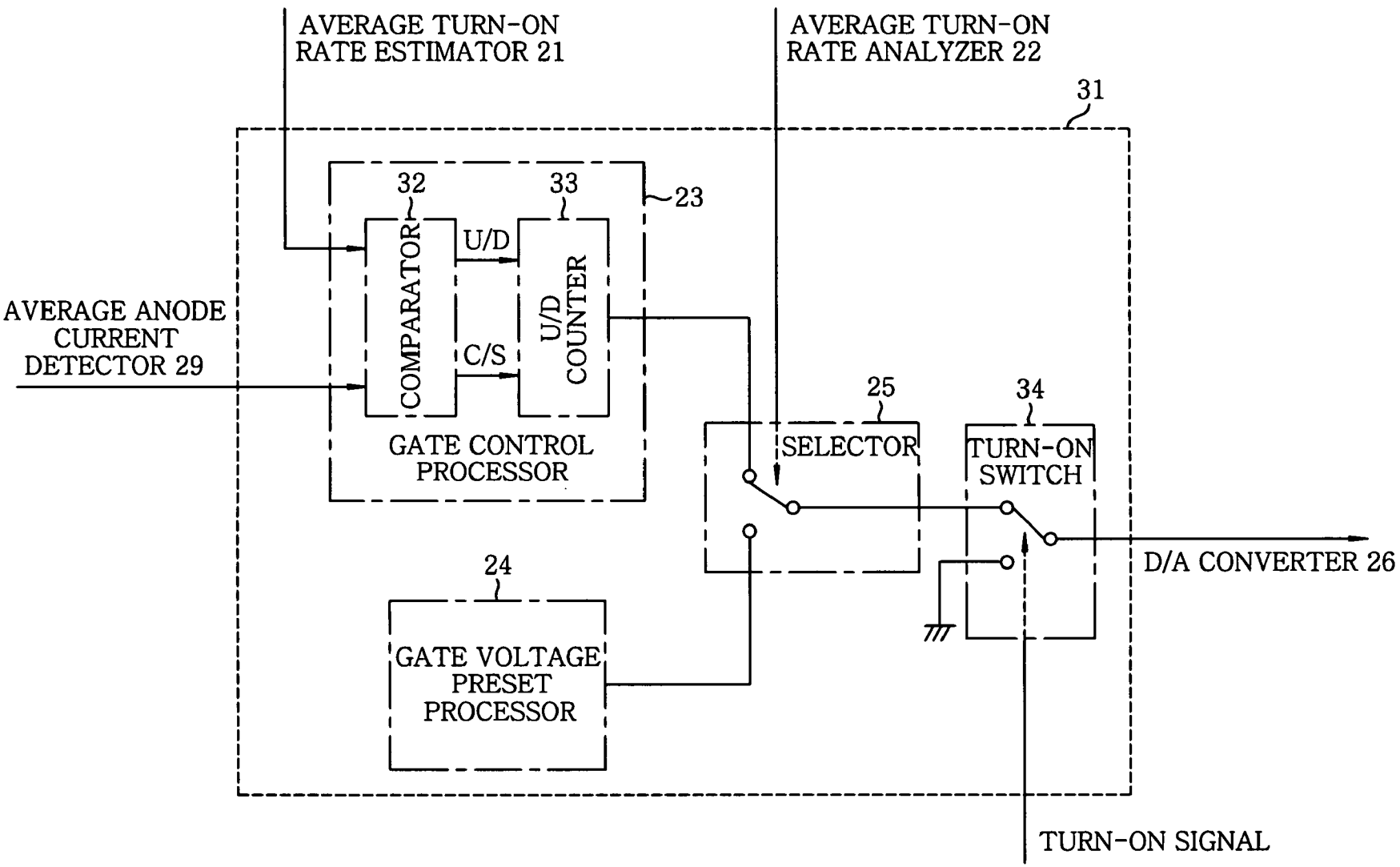
FIG. 2 illustrates a turn-on control unit in accordance with a first preferred embodiment of the present invention.

Although no clock is shown in FIGS. 1 and 2, each of internal elements of the brightness control device 9 configured by a random logic written in the FPGA is configured by circuits synchronized based on a master clock extracted from the display data.

First Preferred Embodiment

FIG. 2 illustrates a configuration diagram of a turn-on control unit 31 in accordance with the first preferred embodiment of the present invention.

The turn-on control unit 31 includes a gate control processor 23; a gate voltage preset processor 24; a selector 25; and a turn-on switch 34. Further, the gate control processor 23 has a comparator 32 and an up/down (U/D) counter 33. Herein, the comparator 32 and the U/D counter 33 function as an exemplary comparing unit, and the gate voltage preset processor 24 functions as an exemplary preset value generation unit.

Hereinafter, the comparator 32 will be described. One of input terminals of the comparator 32 is connected to the average turn-on rate estimator 21, and the other of input terminals of the comparator 32 is connected to the average anode current detector 29. Further, the comparator 32 compares a magnitude of the average anode current with that of the average turn-on rate, and then outputs a U/D signal to select either an up-count or a down-count operation of the U/D counter 33. Herein, although the dimension of the average anode current is $A/m^2$ whereas the average turn-on rate is a dimensionless number, the magnitude of the average anode current can be compared with that of the average turn-on rate by properly resealing the magnitude of the average anode current (hereinafter, the magnitude of the average anode current obtained by resealing as described above will be referred to as "average anode current value"). Since the present embodiment employs a feedback control system, the down-count operation is performed if the average anode current value is greater than the average turn-on rate, and the up-count operation is performed if the average anode current value is smaller than the average turn-on rate.

Further, the comparator 32, which is a hysteresis comparator having a blind zone, outputs a C/S signal to suspend the operation of the U/D counter 33 so that the U/D counter 33 maintains a current count value if a difference between the average anode current value and the average turn-on rate is smaller than or equal to a predetermined value (a boundary value of the blind zone).

Figure 3:
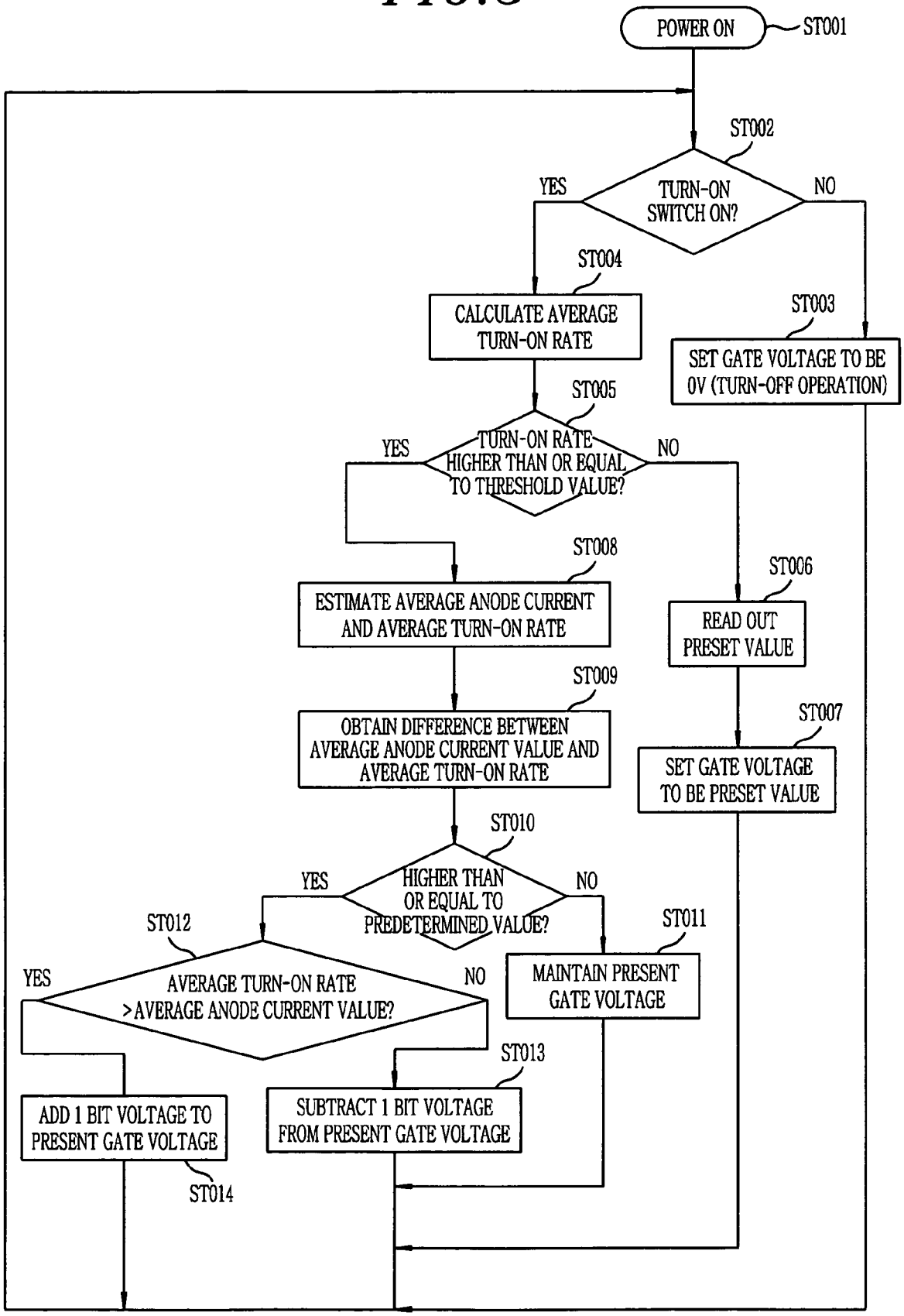
FIG. 3 presents a flow chart for describing operations of the brightness control device in the field emission device in accordance with the first preferred embodiment of the present invention.

Further, although no clock is shown in FIG. 3, a clock signal is inputted to the U/D counter 33, and every operation of the U/D counter 33 is synchronized by the clock signal. In addition, the U/D counter 33 and the gate voltage preset processor 24 respectively outputs a plurality of bits in parallel as output signals thereof, and a plurality of bits are selected in parallel by the selector 25 and the turn-on switch, respectively. The number of parallel bits in the output signal of the selector 25 is same as that of the turn-on switch as well as that of the A/D converter 28. Further, the number of parallel bits in the output signal of the selector 25 is also same as the number of parallel bits in an input signal of the D/A converter 26.

Further, in accordance with the present embodiment, the gate voltage preset processor 24 outputs a digital preset value that has a plurality of bits. The preset value may be provided as data stored in a ROM, or, alternatively, the plurality of the bits in the preset value may be predetermined to set as either a high or low level value corresponding thereto, respectively.

Hereinafter, operations of the display apparatus 1 and the brightness control device 9 in accordance with the first preferred embodiment will be described with reference to FIG. 3.

First, the operation process is started by powering on the display apparatus 1 (step ST001).

Next, it is checked whether or not the turn-on switch is ON (step ST002). Herein, if the turn-on switch is ON, it is commanded that the display apparatus 1 performs an image display thereon, and, if the turn-on switch is OFF, it is commanded that the display apparatus 1 does not perform an image display thereon. In this step, it is the turn-on switch 34 shown in FIG. 2 that performs the operations pursuant thereto.

If the result is NO in step ST002, the process moves on to step ST003 to set the gate voltage to be 0V (turn-off operation), and, thereafter, the process returns to step ST002.

However, if the result is YES in step ST002, the process moves on to step ST004 to calculate the average turn-on rate. In this step, it is the data sum calculator 20 and the average turn-on rate estimator 21 shown in FIG. 1 that perform the operations pursuant thereto.

Thereafter, it is checked whether or not the average turn-on rate is higher than or equal to the threshold value. Herein, the threshold value is set to be, for example, 30%. In this step, it is the average turn-on rate analyzer 22 shown in FIG. 1 that performs the operations pursuant thereto.

In step ST005, if the result is NO, i.e., the average turn-on rate is low, the process moves on to step ST006 to read out the preset value, and then to step ST007 to set the gate voltage to be the preset value. Thereafter, the process returns to step ST002. In step ST006, it is the gate voltage preset processor 24 and the selector 25 shown in FIG. 1 that perform the operations pursuant thereto. In addition, in step ST007, it is the D/A converter 26 shown in FIG. 1 that performs the operations pursuant thereto.

However, in step ST005, if the result is YES, i.e., the average turn-on rate is high, the process moves on to step ST008 to estimate the average anode current and the average turn-on rate. In this step, it is the anode current detector 27, the A/D converter 28, the average anode current detector 29, the data sum calculator 20 and the average turn-on rate estimator 21 shown in FIG. 1 that perform the operations pursuant thereto.

Next, the difference between the average anode current value and the average turn-on rate is calculated (step ST009). In this step, it is the comparator 32 shown in FIG. 2 that performs the operations pursuant thereto.

Thereafter, it is checked whether or not the difference between the average anode current value and the average turn-on rate is greater than or equal to the predetermined value (step ST010). In this step, it is the comparator 32 shown in FIG. 2 that performs the operations pursuant thereto. This step is performed in order to prepare a blind zone, which stabilizes the count value of the U/D counter 33 so that the emission brightness can be prevented from being changed unnecessarily. Herein, although the dimension of the average anode current is $A/m^2$ whereas the average turn-on rate is a dimensionless number, the average anode current value is properly rescaled as described above to be compared with the average turn-on rate.

If the result is NO in step ST010, i.e., the difference between the average anode current value and the average turn-on rate is smaller than the predetermined value, the process moves on to step ST011 to maintain the present gate voltage. Thereafter, the process moves on to step ST002. In step ST011, it is the U/D counter 33 shown in FIG. 2 and the D/A converter 26 shown in FIG. 1 that perform the operations pursuant thereto.

If the result is YES in step ST010, i.e., the difference between the average anode current value and the average turn-on rate is greater than or equal to the predetermined value, the process moves on to step ST012 to check whether or not the average anode current value is greater than the average turn-on rate. Then, if the result is NO in step ST012, i.e., the average anode current value is not smaller than the average turn-on rate, the process moves on to step ST013 to subtract a specific voltage corresponding to 1 bit (hereinafter, referred to as "1-bit voltage") from the present gate voltage. That is, since it has been found in step ST012 that the present average anode current is greater than a target average anode current corresponding to a target brightness indicated by the average turn-on rate, step ST013 is performed to lower the gate voltage of the selected gate electrode, thereby reducing the average anode current so that the average anode current value can be made closer to the average turn-on rate in a direction of a negative feedback. Thereafter, the process returns to step ST002. In step ST012, it is the U/D counter 33 shown in FIG. 2 and the D/A converter 26 shown in FIG. 1 that perform the operations pursuant thereto.

However, if the result is YES in step ST012, i.e., the average anode current value is smaller than the average turn-on rate, the process moves on to step ST014 to add the 1-bit voltage to the present gate voltage. That is, since it has been found in step ST012 that the present average anode current is smaller than a target average anode current corresponding to a target brightness indicated by the average turn-on rate, step ST014 is performed to increase the gate voltage of the selected gate electrode, thereby increasing the average anode current so that the average anode current value can be made closer to the average turn-on rate in a direction of a negative feedback. Thereafter, the process returns to step ST002. In step ST014, it is the U/D counter 33 shown in FIG. 2 and the D/A converter 26 shown in FIG. 1 that perform the operations pursuant thereto.

In the display apparatus and the brightness control device in accordance with the first preferred embodiment, when the average turn-on rate is higher than or equal to the threshold value, e.g., 30%, the above-described feedback control is used for adjusting the gate voltage, so that the brightness of the FED panel 10 is controlled in accordance with the display data. On the other hand, when the average turn-on rate is lower than the threshold value, e.g., 30%, the brightness of the FED panel 10 is determined by setting the gate voltage to be the preset value. In this manner, the feedback control capable of stabilizing the emission brightness is performed if the average turn-on rate is higher than or equal to, e.g., 30%, whereas the emission brightness is set by a fixed value without performing the feedback control if the average turn-on rate is lower than, e.g., 30%. Therefore, the brightness can be prevented from being deviated from a desired level, even when the blind zone of the anode current in the feedback control system becomes non-negligible in comparison to the anode current or the SNR of the anode current is decreased.

Further, since the average turn-on rate is estimated with respect to a single frame, it is possible to control an entire brightness of an image displayed in a single frame. In particular, if the image to be displayed is still or has little motion so that the correlation between frames is high, and when the average turn-on rate is high and the feedback control of the gate voltage is performed, it is possible to obtain error signals suitable for controlling the brightness with a sufficient accuracy by obtaining an average emission brightness of a single frame. On the other hand, when the average turn-on rate is low and the gate voltage is set by the gate voltage preset processor 24, it is possible to perform a brightness control such that the emission brightness changes smoothly and properly, because the emission brightness changes noticeably only if the brightness of the image to be displayed changes greatly, and changes little if the correlation between frames is high and the emission brightness does not vary much among frames in the image to be displayed.

Second Preferred Embodiment

Figure 4:
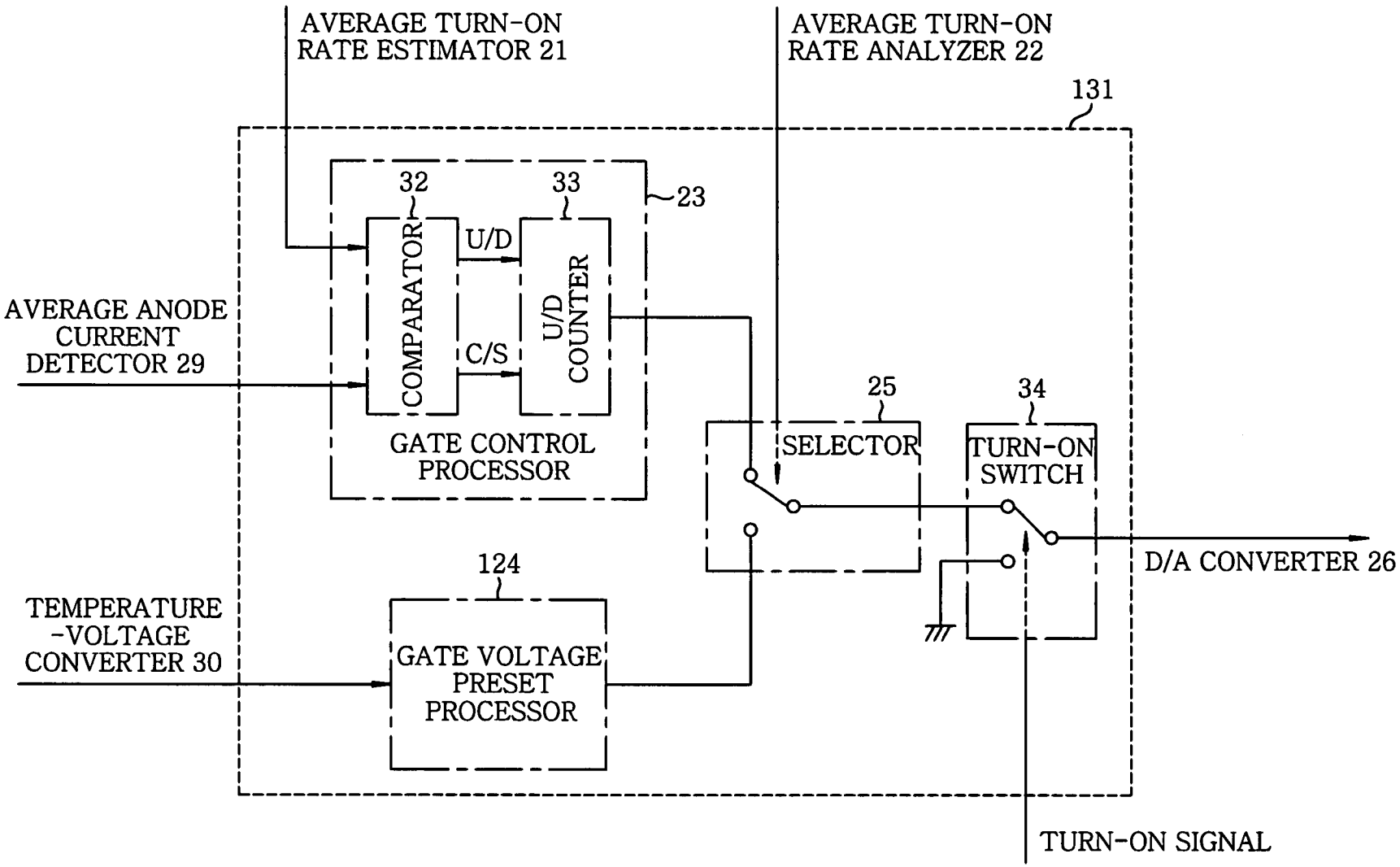
FIG. 4 describes a turn-on control unit in accordance with a second preferred embodiment of the present invention.

The display apparatus in accordance with the second preferred embodiment differs from that of the first preferred embodiment only in that the turn-on control unit 131 shown in FIG. 4 is used instead of the turn-on control unit 31. In accordance with the first preferred embodiment, an output level of the signal outputted from the gate voltage preset processor 24 and inputted to the selector 25 is a constant value. However, in accordance with the second preferred embodiment, an output level of a signal outputted from the gate voltage preset processor 124 and inputted to the selector 25 is changed in accordance with a temperature of the FED panel 10.

Hereinafter, a relation between the temperature of the FED panel 10 and the emission brightness will be described. The resistor layer 104 shown in FIG. 8 is made of a-Si, whose resistance changes as the temperature thereof changes. Therefore, in the FED panel 10, a voltage difference between the gate electrode and the emitter electrode required for securing a specific emission brightness is reduced as the temperature of the FED panel 10 increases. As a result, if the gate voltage is set to be constant when the average turn-on rate is lower than the threshold value, e.g., 30%, a deviation of the emission brightness occurs due to a temperature change. The second preferred embodiment is proposed to solve such problem.

In the following, the turn-on control unit 131 in the second embodiment will be described with reference to FIG. 4. Like parts are denoted by like numerals in FIG. 4, and the explanations thereof will be omitted.

FIG. 4 shows a configuration diagram of the turn-on control unit 131, which, unlike the turn-on control unit 31 in the first embodiment, an output level of an output signal of the gate voltage preset processor 124 is changed in response to an output signal of a temperature-voltage converter 30. More specifically, the gate voltage preset processor 124 is configured by a random access memory (RAM) or a read-only memory (ROM), and the temperature-voltage converter 30 generates an address corresponding to the temperature, so that data value stored in a corresponding address of the RAM or the ROM is outputted to the selector 25.

Figure 5:
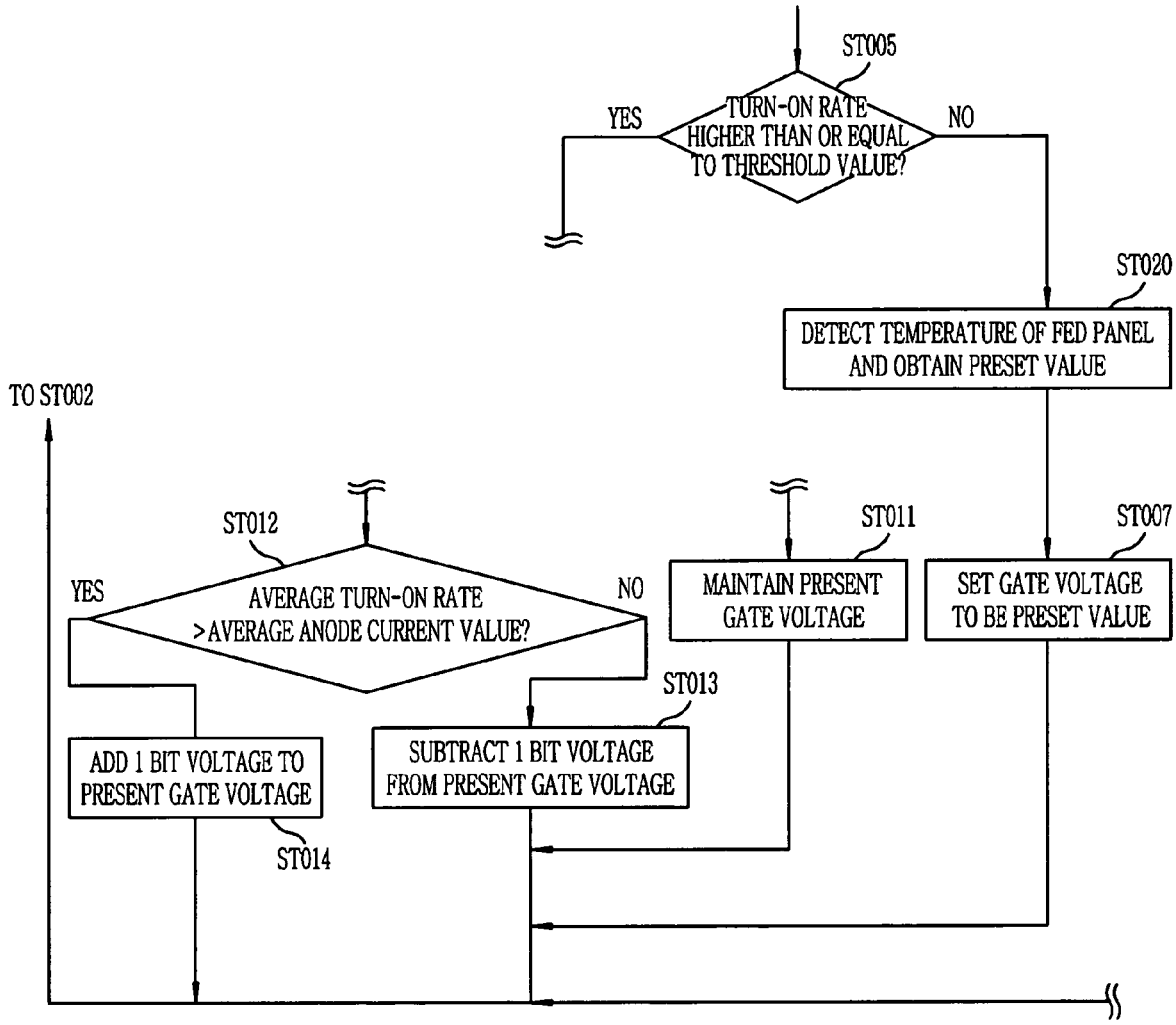
FIG. 5 provides a flow chart for describing distinctive operations of the brightness control device in the field emission device in accordance with the second preferred embodiment of the present invention.

FIG. 5 provides a flow chart for describing distinctive operations of the brightness control device in accordance with the second preferred embodiment of the present invention.

In FIG. 5, operations different from those of the first preferred embodiment are illustrated, whereas operations same as those of the first preferred embodiment are omitted. The operation process of the second preferred embodiment differs from that of the first preferred embodiment in that step ST006 of reading out the preset value as shown in FIG. 3 is replaced by step ST020 of detecting the temperature of the FED panel 10 to obtain a preset value in accordance with the detected temperature. In step ST020, it is the gate voltage preset processor 124 shown in FIG. 4 that performs the operations pursuant thereto.

Since a table representing the relation between the temperature and the voltage applied to the gate electrode is stored to be used in accordance with the display apparatus and the brightness control device of the second preferred embodiment, the brightness can be prevented from being deviated from a desired level due to the blind zone of the anode current in the feedback control system or a deterioration of the SNR of the anode current when the average turn-on rate is lower than the threshold value, e.g., 30%, and, at the same time, the emission brightness can be stabilized regardless of the temperature of the FED panel 10 even in case of a low brightness.

Third Preferred Embodiment

Figure 6:
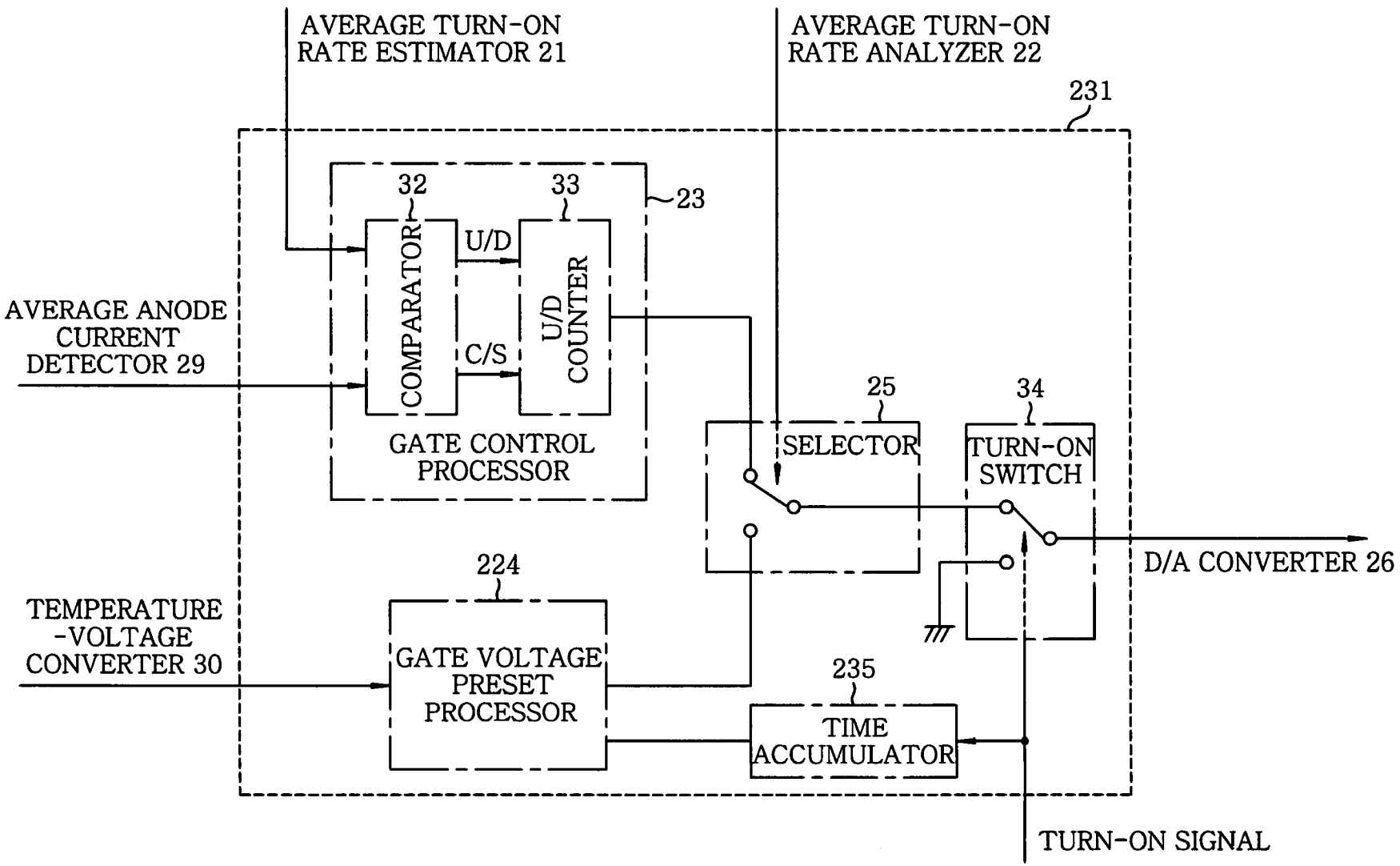
FIG. 6 describes a turn-on control unit in accordance with a third preferred embodiment of the present invention.

The display apparatus in accordance with the third preferred embodiment differs from that of the second preferred embodiment only in that the turn-on control unit 231 shown in FIG. 6 is used instead of the turn-on control unit 131. In accordance with the second preferred embodiment, the output level of the output signal of the gate voltage preset processor 124 is changed in accordance with a temperature of the FED panel 10. In addition to this, the third preferred embodiment has a new feature that compensates a temporal variation of the FED panel.

In the FED panel 10, a voltage difference between the gate electrode and the emitter electrode required for securing a specific level of the emission brightness increases as the emission time elapses due to a deterioration of the phosphor material, a weakening of the electron emission and the like. As a result, if the gate voltage is set to be dependent only on the temperature of the FED panel 10 when the average turn-on rate is lower than or equal to the threshold value, e.g., 30%, a deviation of the emission brightness occurs as the emission time elapses. The third preferred embodiment is proposed to solve such problem.

In the following, the turn-on control unit 231 in the third embodiment will be described with reference to FIG. 6. Like parts are denoted by like numerals in FIG. 6, and the explanations thereof will be omitted.

FIG. 6 shows a configuration diagram of the turn-on control unit 231, which, unlike the turn-on control unit 131 in the second embodiment, further includes a time accumulator 235, and an output level of an output signal of the gate voltage preset processor 224 is changed in response to output signals of the time accumulator 235 and the temperature-voltage converter 30.

Herein, the time accumulator 235 accumulates the emission time over which the FED panel 10 has emitted light by performing the following steps of: (a) counting the clock generated at a regular interval by using an internal counter; (b) storing the counted number in a non-volatile memory when the turn-on switch 34 becomes OFF; (c) transferring the counted number stored in the non-volatile memory into the counter when the turn-on switch 34 becomes ON; and (d) continuing the counting operation of the internal counter.

More specifically, the gate voltage preset processor 224 is configured by a RAM or a ROM, and generates an address in response to the output signals of the time accumulator 235 and the temperature-voltage converter 30, so that data value stored in a corresponding address of the RAM or the ROM is outputted to the selector 25. Regarding the address generation, for example, the address is represented by 12 bits such that upper 6 bits thereof are dependent on the output level of the output signal of the temperature-voltage converter 30 whereas lower 6 bits thereof are dependent on the output level of the output signal of the time accumulator 235. Alternatively, the 12 bits of the address are determined by a predetermined mathematical function, wherein the emission time and the temperature are input variables thereof, and the address is the output thereof.

Figure 7:
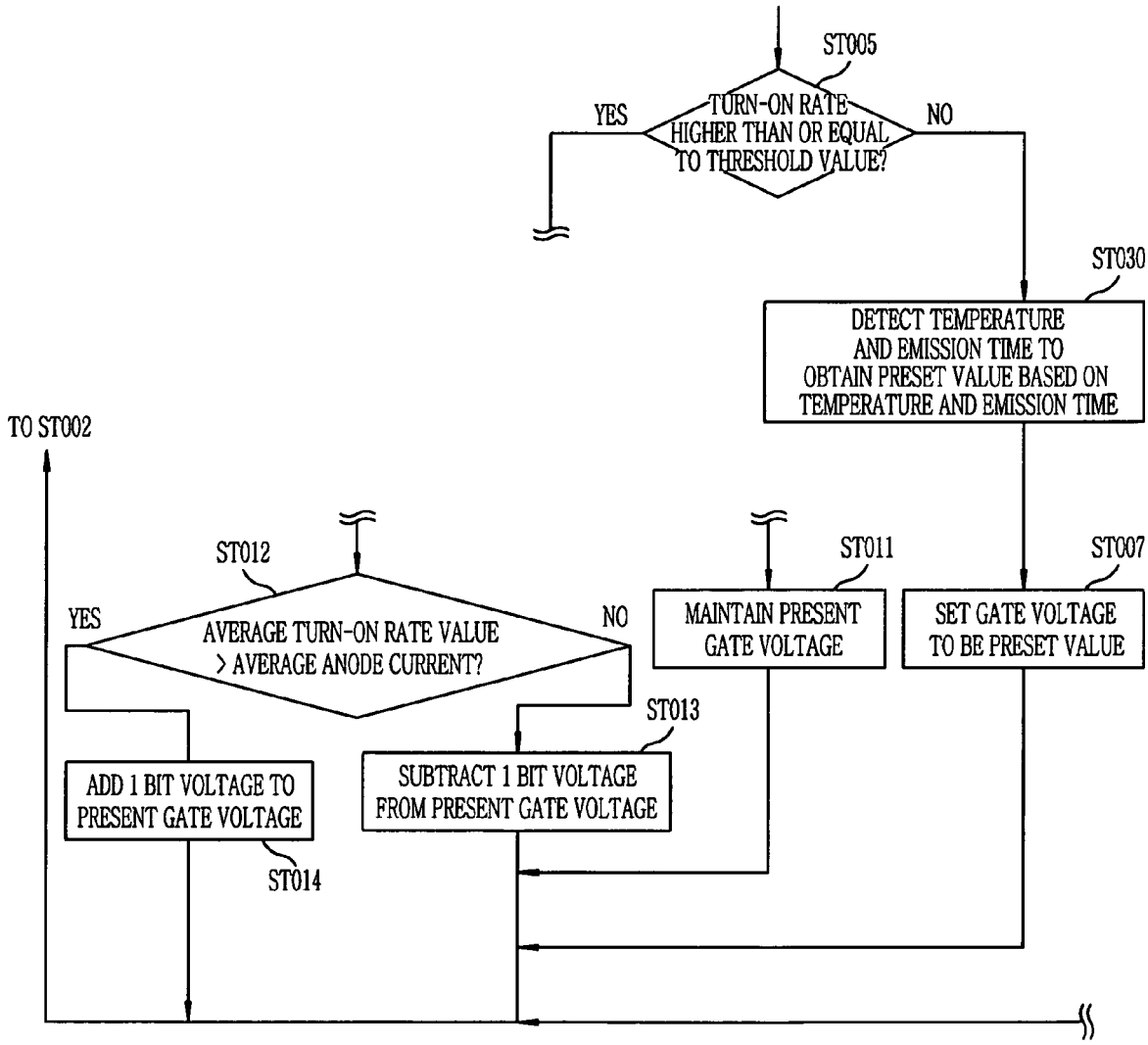
FIG. 7 provides a flow chart for describing distinctive operations of the brightness control device in the field emission device in accordance with the third preferred embodiment of the present invention.

FIG. 7 provides a flow chart for describing distinctive operations of the brightness control device in accordance with the third preferred embodiment of the present invention.

In FIG. 7, operations different from those of the first preferred embodiment are illustrated, whereas operations same as those of the first preferred embodiment are omitted. The operation process of the third preferred embodiment differs from that of the first preferred embodiment in that step ST006 of reading out the preset value as shown in FIG. 3 is replaced by step ST030 of detecting the temperature and the emission time of the FED panel 10 to obtain a preset value in accordance with the detected temperature and emission time. In step ST030, it is the gate voltage preset processor 224 and time accumulator 225 shown in FIG. 6 that perform the operations pursuant thereto.

Since a table representing the relation between the emission time, the temperature and the gate voltage is stored to be used in accordance with the display apparatus and the brightness control device of the third preferred embodiment, the brightness can be prevented from being deviated from a desired level due to the blind zone of the anode current in the feedback control system or a deterioration of the SNR of the anode current when the average turn-on rate is lower than or equal to the threshold value, e.g., 30%, and, at the same time, the emission brightness can be stabilized regardless of the temperature and the emission time of the FED panel 10 even in case of a low brightness. Further, even when the temporal variation has a negative effect on the emission brightness of the FED panel 10, the emission brightness is maintained to be approximately constant by compensating the negative effect, so that a life span of the display apparatus can be practically extended.

Fourth Preferred Embodiment

The turn-on control unit in accordance with the fourth preferred embodiment (not shown in the drawings) is same as that shown in FIG. 6, except that the gate voltage preset processor 224 does not receive an input signal from the temperature-voltage converter 30. Therefore, in the following, the fourth preferred embodiment of the present invention will be described with reference to FIG. 6. In accordance with the third preferred embodiment, the output level of the output signal of the gate voltage preset processor 224 is changed in accordance with the temperature and the emission time of the FED panel 10. However, in accordance with the fourth preferred embodiment, the output level of the output signal of the gate voltage preset processor 224 is dependent only on the emission time of the FED panel 10.

More specifically, the gate voltage preset processor 224 is configured by a RAM or a ROM, and generates an address in response to the output signal of the time accumulator 235, so that data value stored in a corresponding address of the RAM or the ROM is outputted to the selector 25.

Since a table representing the relation between the emission time and the gate voltage is stored to be used in accordance with the display apparatus and the brightness control device of the fourth preferred embodiment, the brightness can be prevented from being deviated from a desired level due to the blind zone of the anode current in the feedback control system or a deterioration of the SNR of the anode current when the average turn-on rate is lower than or equal to the threshold value, e.g., 30%, and, at the same time, the emission brightness can be stabilized regardless of the emission time of the FED panel 10 even in case of a low brightness. Further, even when the temporal variation has a negative effect on the emission brightness of the FED panel 10, the emission brightness is maintained to be approximately constant by compensating the negative effect, so that a life span of the display apparatus can be practically extended.

Alternative Embodiments

There will be described several alternative embodiments and modifications of the present invention.

(Driving of Cathode Electrode and Gate Electrode)

In accordance with the first to the fourth preferred embodiment, voltages corresponding to the respective display data are applied to the respective cathode electrodes, and the gate electrodes are sequentially selected one by one as the selected gate electrode to be supplied with a voltage in accordance with the output signal of the D/A converter 26, whereas the remaining gate electrodes (i.e., non-selected electrodes) are supplied with a voltage for preventing the emitters from emitting electrons. However, such configuration may be modified as long as the second electrode and the third electrode are supplied with driving voltages. An example of such modified configurations will be described in the following.

In accordance with an exemplary modified configuration, the function of the cathode electrode is interchanged with that of the gate electrode. That is, the respective gate electrodes are supplied with voltages corresponding to the respective display data, and the cathode electrodes are sequentially selected one by one as a selected cathode electrode to be supplied with a voltage in accordance with the output of the D/A converter 26, whereas the remaining cathode electrodes (i.e., non-selected electrodes) are supplied with a voltage for preventing the emitters from emitting electrons.

(First Electrode Current Detection Unit, Display Data Amount Estimation Unit, Average Turn-on Rate Analysis Unit)

In accordance with the first to the fourth preferred embodiment, the first electrode current detection unit, i.e., the anode current detection unit includes the anode current detector 27 for detecting the anode current and the average anode current detector for obtaining the average anode current over a specific period of time. However, such configuration of the anode current detection unit may be modified as long as it is possible to detect the current flowing in the first electrode.

For example, the anode current detection unit may calculate a definite integral of the current flowing through the anode electrode over a specific period of time to detect an amount of electric charge that has flown through the anode electrode.

Further, in accordance with the first to the fourth preferred embodiment, the display data amount detection unit includes a data sum calculator 20 for adding up the display data over a specific period of time; an average turn-on rate estimator 21 for obtaining the average turn-on rate over a specific period of time. However, such configuration of the display data amount detection unit may be modified as long as it is possible to detect a signal corresponding to the amount of the display data inputted to the second electrode.

For example, the display data amount detection unit may obtain a data sum by summing up the display data inputted to the cathode electrode or the gate electrode over a specific period of time, and in this case, the display data detection unit may be configured by only the data sum calculator 20.

Further, in accordance with the first to the fourth preferred embodiment, the average turn-on rate analysis unit is configured by an average turn-on rate analyzer 22 for determining whether the average turn-on rate is greater than, equal to or smaller than the threshold value. However, such configuration of the average turn-on rate analysis unit may be modified as long as it is possible to find whether the signal corresponding to the amount of the display data is greater than, equal to or smaller than a predetermined value.

For example, the average turn-on rate analysis unit may include the data sum calculator 20 for obtaining a data sum of display data inputted to the cathode electrode or the gate electrode over the specific period of time; and a comparator for comparing the data sum obtained by the data sum calculator and a predetermined value. Herein, the predetermined value is obtained by multiplying W (i.e., the largest possible value of the display data), a predetermined coefficient (e.g., 0.3), and the number of display data displayed over a specific period of time.

(Hardware Configuration)

In accordance with the first to the fourth preferred embodiment, the brightness control device 9 is operated by the random logic written in the FPGA. However, the brightness control device 9 may be configured by a combination of a software stored in a MPU, an A/D converter, a D/A converter, and digital devices such as an AND gate, an OR gate, a JK flip-flop, and the like. Further, it is also possible that the first electrode current detection unit, the display data amount detection unit, the comparator unit, the preset value generation unit and the average turn-on rate analysis unit may be configured by analog circuits.

For example, the first electrode current detection unit may be configured such that a voltage across a current detection resistor is integrated over a specific period of time or averaged by a low pass filter. Further, the display data amount detection unit may be configured such that the display data is inputted as a digital signal, and a D/A converted voltage of the digital signal is integrated over a specific period of time or averaged by a low pass filter. Further, the comparator unit may be configured by an operational amplifier, and the preset value generation unit may be configured such that an output of a constant voltage supply is voltage divided by a resistor. In addition, the average turn-on rate analysis unit may be configured by an analog comparator.

Further, the temperature detection unit for detecting a temperature may be configured by a monitor resistive pattern formed of a-Si in the FED panel or a temperature detection device such as a thermistor press-attached to the FED panel.

(Time Period)

In accordance with the first to the fourth preferred embodiment, the time period for detecting the current flowing through the first electrode, the time period for detecting the amount of the display data inputted to the second electrode and the time period for obtaining the average turn-on rate are set to be an amount of time period corresponding to a single frame. However, the time period may be set to be an amount of time over which a selected electrode remains to be selected. Further, the time period may also be set to be an amount of time corresponding to a plurality of frames (or a plurality of still images). If the time period is set to be an integer multiple of the amount of time over which the selected electrode remains to be selected, output signals of the D/A converter 26 are switched in a manner synchronous with a horizontal synchronizing signal or a vertical synchronizing signal, so that the displayed image can be made smooth and proper. However, the time period may also be set without being restricted as described above. In addition, the brightness control device 9 may be configured to select one of the above-described methods of setting the time period.

Further, as a modification of the first preferred embodiment, it is also possible to set the output of the gate voltage preset processor 24 by an operation of a feedback system during a preceding operation of the display apparatus (i.e., before the turn-on switch was turned OFF last time) instead of setting the output of the gate voltage preset processor 24 to be a fixed value. In this case, even when the emission brightness of the FED panel 10 is low, the emission brightness is maintained to be approximately constant by compensating the change in the brightness due to the emission time.

Further, as a modification of the third preferred embodiment, the preset value may be set to be a gate voltage corresponding to the emission time multiplied by the average turn-on rate instead of setting the preset value to be a gate voltage corresponding to the emission time. In this manner, a change in the characteristic of the FED panel 10 can be detected more accurately, so that the emission brightness can be maintained to be stabilized more effectively even when the emission brightness of the FED panel is low.

As described above, a display apparatus employing a field emission device and brightness control device and method therefor in accordance with the present invention can stabilize a brightness regardless of a temperature change or the like, even when the brightness of the FED is low.

While the invention has been shown and described with respect to the preferred embodiments, it will be understood by those skilled in the art that various changes and modification may be made without departing from the scope of the invention as defined in the following claims.

What is claimed is:

1. A display apparatus comprising:

a field emission device including a first electrode serving as a display plate on which phosphor material is coated, and a second and a third electrode for emitting electrons to be ejected onto the first electrode, wherein the phosphor material emits light when the electrons are ejected thereonto;

a voltage application unit for applying driving voltages to the second and the third electrode to control an emitted amount of the electrons in accordance with display data and allow a specific part of the phosphor material to emit light; and a brightness control unit for controlling an emission brightness of the phosphor material, wherein the brightness control unit includes:

a first electrode current detection unit for detecting a signal corresponding to a current flowing through the first electrode over a specific period of time;

a display data amount estimation unit for detecting a signal corresponding to the display data inputted to the second electrode over the specific period of time;

a comparing unit for generating an error signal representing a difference between the signal corresponding to the current flowing through the first electrode and the signal corresponding to the display data;

a preset value generation unit for generating a preset value;

an average turn-on rate detection unit for calculating an average turn-on rate indicating a degree to which the phosphor material emits light over the specific period of time;

an average turn-on rate analysis unit for finding whether the average turn-on rate is greater than, equal to or smaller than a threshold value; and a selection unit for making the third electrode driven by a feedback control system in accordance with the error signal if the average turn-on rate is found to be greater than or equal to the preset value, and by the preset value if the average turn-on rate is found to be smaller than the preset value.

2. The display apparatus for claim 1, wherein the preset value generated by the preset value generation unit is a predetermined constant.

3. The display apparatus for claim 1, wherein the brightness control device further includes:

a temperature detection unit for detecting a temperature of the field emission device, wherein the preset value generated by the preset value generation unit is dependent on the temperature detected by the temperature detection unit.

4. The display apparatus for claim 1, wherein the brightness control device further includes:

a time accumulator for detecting a time period over which the field emission device has been operated, wherein the preset value generated by the preset value generation unit is dependent on the time period over which the field emission device has been operated.

5. The display apparatus for claim 1, wherein the brightness control device further includes:

a temperature detection unit for detecting a temperature of the field emission device; and a time accumulator for detecting a time period over which the field emission device has been operated, wherein the preset value generated by the preset value generation unit is dependent on the temperature detected by the temperature detection unit and the time period over which the field emission device has been operated.

6. The display apparatus for claim 1, wherein the first electrode current detection unit includes:

an anode current detector for detecting an anode current; and an average anode current detector for obtaining an average anode current representing an average value of the anode current over the specific period of time, and wherein the display data amount estimation unit and the average turn-on rate detection unit include:

a data sum calculator for summing up the display data inputted to a cathode electrode to obtain a data sum; and an average turn-on rate estimator for calculating an average turn-on rate that is defined as the data sum obtained by the data sum calculator divided by a largest possible value of the data sum, and wherein the average turn-on rate analysis unit includes:

an average turn-on rate analyzer for determining whether the average turn-on rate is greater than, equal to or smaller than the threshold value.

7. The display apparatus for claim 1, wherein the specific period of time is an amount of time over which the light is emitted by the field emission device to display a single still image in a frame.

8. A brightness control device for controlling an emission brightness of a field emission device including a first electrode serving as a display plate on which phosphor material is coated, and a second and a third electrode for emitting electrons to be ejected onto the first electrode, the phosphor material emitting light when the electrons are ejected thereonto, the brightness control device comprising:

a first electrode current detection unit for detecting a signal corresponding to a current flowing through the first electrode over a specific period of time;

a display data amount estimation unit for detecting a signal corresponding to the display data inputted to the second electrode over the specific period of time;

a comparing unit for generating an error signal representing a difference between the signal corresponding to the current flowing through the first electrode and the signal corresponding to the display data;

a preset value generation unit for generating a preset value;

an average turn-on rate detection unit for calculating an average turn-on rate indicating a degree to which the phosphor material emits light over the specific period of time;

an average turn-on rate analysis unit for finding whether the average turn-on rate is greater than, equal to or smaller than a threshold value; and a selection unit for making the third electrode driven by a feedback control system in accordance with the error signal if the average turn-on rate is found to be greater than or equal to the preset value, and by the preset value if the average turn-on rate is found to be smaller than the preset value.

9. A brightness control method of controlling an emission brightness of a field emission device including a first electrode serving as a display plate on which phosphor material is coated, and a second and a third electrode for emitting electrons to be ejected onto the first electrode, the phosphor material emitting light when the electrons are ejected thereonto, the brightness control method comprising the steps of:

detecting a signal corresponding to a current flowing through the first electrode over a specific period of time;

detecting a signal corresponding to the display data inputted to the second electrode over the specific period of time;

generating an error signal representing a difference between the signal corresponding to the current flowing through the first electrode and the signal corresponding to the display data;

finding whether the average turn-on rate is greater than, equal to or smaller than a threshold value, the average turn-on rate indicating a degree to which the phosphor material emits light over the specific period of time; and making the third electrode driven by a feedback control system in accordance with the error signal if the average turn-on rate is found to be greater than or equal to the preset value, and by the preset value if the average turn-on rate is found to be smaller than the preset value.

* * * * *